US005253618A

United States Patent [19]

Takahashi et al.

[11] Patent Number: 5,253,618

[45] Date of Patent: Oct. 19, 1993

[54] MARINE ENGINE

[75] Inventors: Masanori Takahashi; Yoshihide Hirano, both of Hamamatsu, Japan

[73] Assignee: Sanshin Kogyo Kabbushiki Kaisha, Hamamatsu, Japan

[21] Appl. No.: 958,236

[22] Filed: Oct. 8, 1992

[30] Foreign Application Priority Data

Nov. 16, 1991 [JP] Japan ..... 3-328061

[51] Int. Cl.[5] ..... F02B 75/02

[52] U.S. Cl. ..... 123/65 BA; 123/559.1

[58] Field of Search ..... 123/65 BA, 559.1

[56] References Cited

U.S. PATENT DOCUMENTS

| | | | |
|---|---|---|---|
| 1,562,169 | 11/1925 | Hefti | 123/65 BA |
| 1,628,894 | 5/1927 | Maupin | 123/65 BA |
| 1,754,724 | 4/1930 | Mead | 123/65 BA |
| 2,107,389 | 2/1938 | Price et al. | 123/65 BA |
| 2,280,839 | 4/1942 | Nallinger | 123/65 BA |
| 2,281,585 | 5/1942 | Kadenacy | 123/65 BA |
| 2,367,565 | 1/1945 | Curtis . | |
| 2,645,214 | 7/1953 | Birnstiel . | |
| 2,744,506 | 5/1956 | Reynolds . | |
| 2,787,987 | 4/1957 | Portmann . | |
| 2,820,339 | 1/1958 | Grieshaber et al. . | |
| 2,887,993 | 5/1959 | Shallenberg . | |
| 3,077,189 | 2/1963 | Earnshaw et al. . | |
| 4,254,752 | 3/1981 | Friddell et al. . | |
| 4,995,347 | 2/1991 | Tate et al. | 123/65 BA |

FOREIGN PATENT DOCUMENTS

| | | |
|---|---|---|
| 0842238 | 6/1952 | Fed. Rep. of Germany . |
| 2-76126 | 6/1990 | Japan . |

*Primary Examiner*—E. Rollins Cross
*Assistant Examiner*—M. Macy
*Attorney, Agent, or Firm*—Ernest A. Beutler

[57] ABSTRACT

An outboard motor having an air compressor for delivering compressed air to a scavenging system for the engine. The air compressor is designed so that when the engine is not running, any moisture which may be present in the pumping cavity of the air compressor will drain out of the outlet opening of the compressor.

13 Claims, 5 Drawing Sheets

MARINE ENGINE

BACKGROUND OF THE INVENTION

This invention relates to a marine engine and more particularly to an improved air compressor for use with a marine engine.

Frequently, internal combustion engines are provided with one or more air compressors which supply compressed air to the engine for its operation. For example, with high output engines frequently there is employed a supercharger for delivering a compressed air charge to the induction system for the engine. Such arrangements are particularly advantageous in conjunction with two-cycle engines because they can not only increase the performance of the engine, but also assist in scavenging. Furthermore, when a supercharger is used with a two-cycle engine it is not necessary to have the intake charge flow through the crankcase chamber of the engine and the amount of lubricant which passes into the exhaust gases can, therefore, be reduced as can lubricant consumption.

However, engines are frequently employed in marine environments, particularly when used to propel a watercraft. This is particularly true in conjunction with outboard motors, which frequently use two-cycle engines.

A disadvantage with the use of an air compressor or supercharger in a marine environment is that the air inducted into the supercharger can contain a large amount of water, particularly salt water. When the engine is not running, this salt water may condense in the supercharger compression chamber and can damage the critical components thereof such as the impeller, intermeshing rotors, supporting shafts and bearings or the like. This is an obviously undesirable result.

It is, therefore, a principal object to this invention to provide an improved air compressor for use with an engine.

It is a further object to this invention to provide an improved air compressor wherein liquids can not accumulate in the compression chamber of the compressor when the compressor is not being driven.

SUMMARY OF THE INVENTION

This invention is adapted to be embodied in an air compressor having an outer housing defining a pumping chamber. A pumping element is supported within the pumping chamber for pumping air from an air inlet opening to an air outlet opening. In accordance with the invention, at least one of the openings has its lower surface disposed no higher than the lower surface of the pumping chamber so that any water accumulating in the pumping chamber may drain from the pumping chamber when the compressor is not operating.

DETAILED DESCRIPTION OF THE PREFERRED EMBODIMENT OF THE INVENTION

Figure 1:
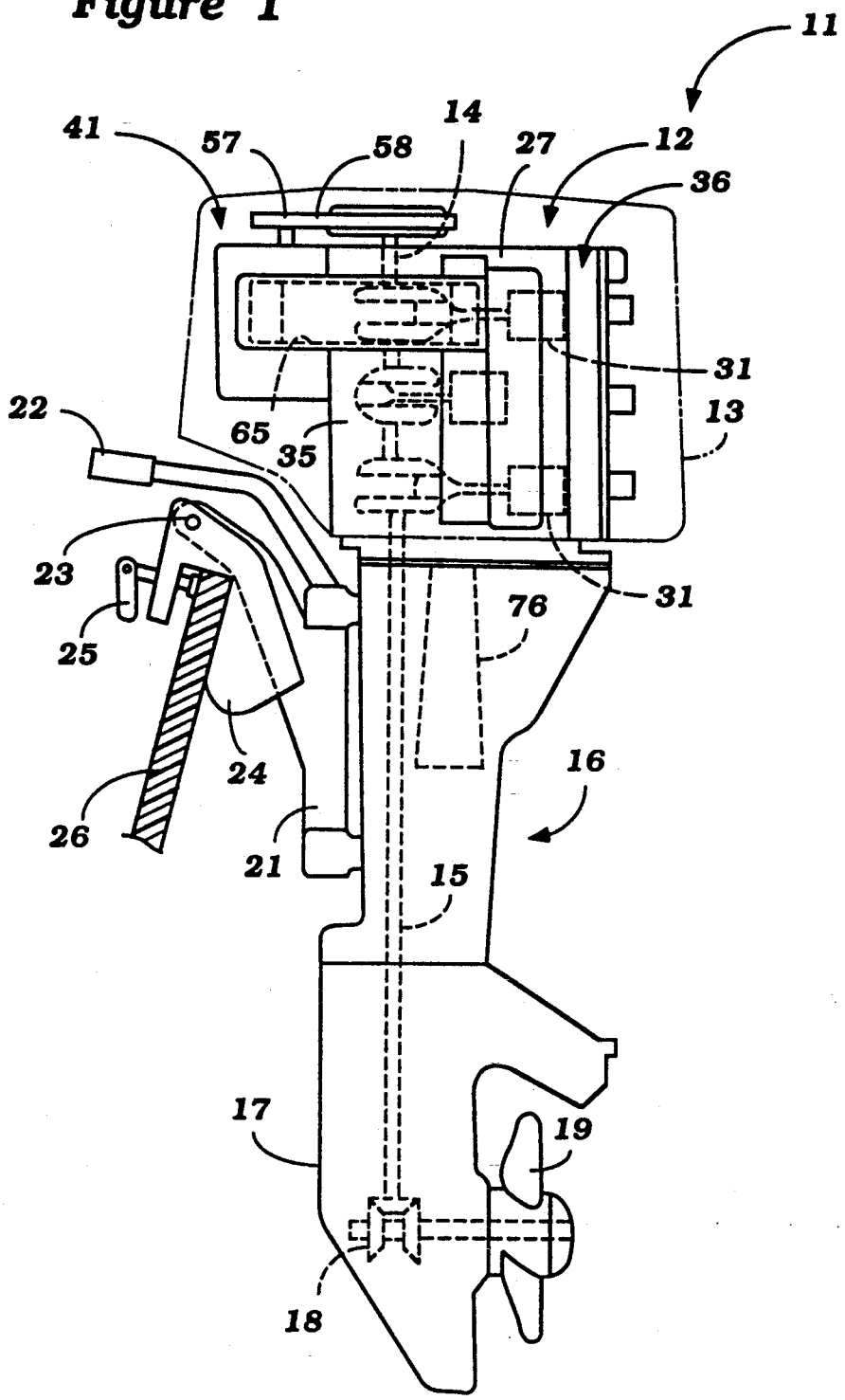
FIG. 1 is a side elevational view of an outboard motor constructed in accordance with an embodiment of the invention, with a portion shown in phantom.
Figure 2:
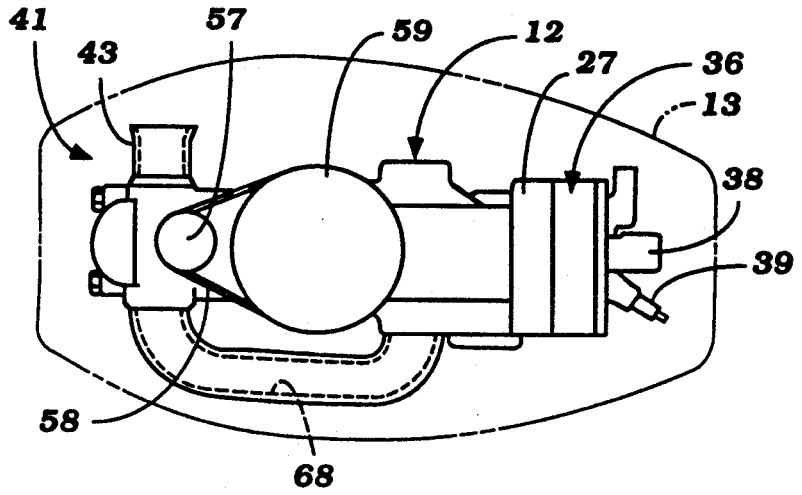
FIG. 2 is a top plan view thereof with the same portion shown in phantom.
Figure 3:
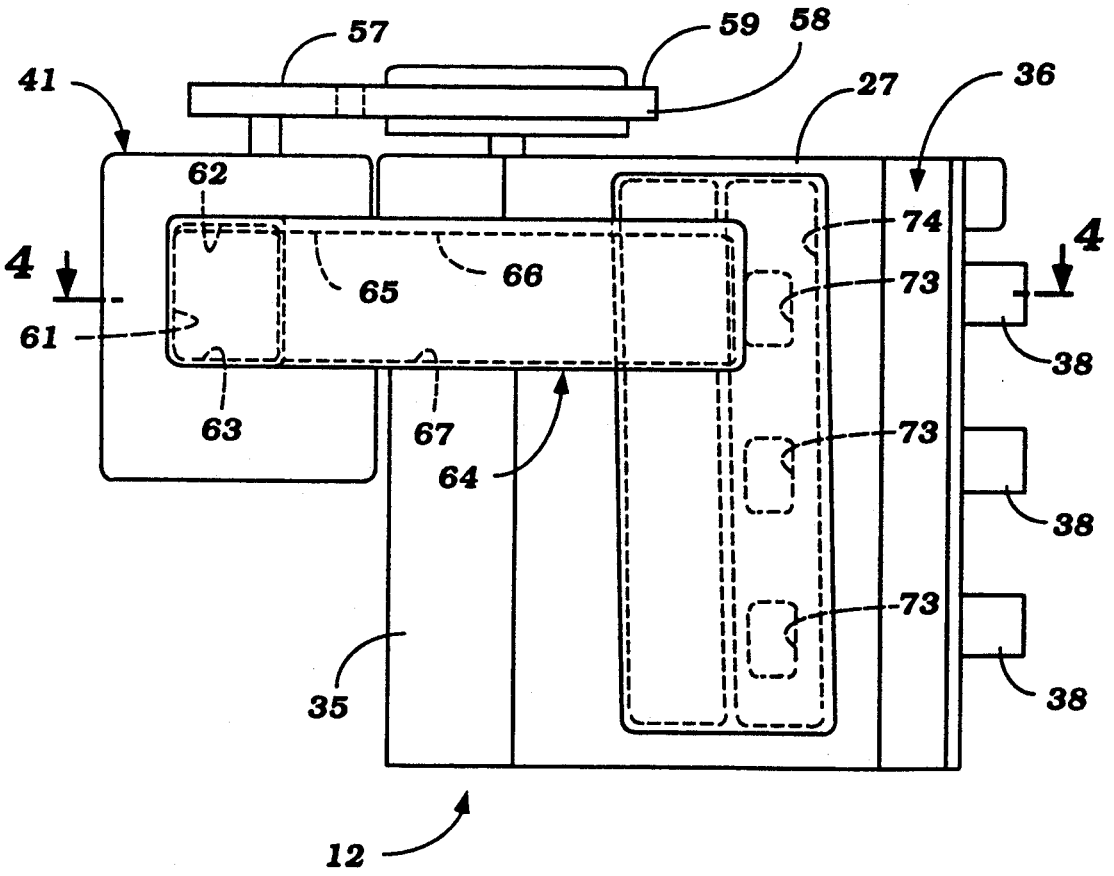
FIG. 3 is an enlarged side elevational view of the internal combustion engine of the outboard motor.

Referring first to FIG. 1, an outboard motor constructed in accordance with an embodiment of the invention is identified generally by the reference numeral 11. The invention is described in conjunction with an outboard motor because the invention has particular utility with internal combustion engines employed in marine propulsion units such as an outboard motor. It is to be understood that the invention can be employed in conjunction with other marine applications than outboard motors such as inboard motors or, for that matter, on other marine environments. In addition, the air compressor, which will be described, may be used with other types of applications than with internal combustion engine. The invention, however, has particular utility in injunction with two-cycle, supercharged, internal combustion engines.

The outboard motor includes a power head that is comprised of an internal combustion engine, indicated generally by the reference numeral 12 and a surrounding protective cowling, shown in phantom and identified by the reference 13.

As is typical with marine practice, the engine 12 is supported with a crankshaft 14 rotating about a vertically extending axis. The crankshaft 14 drives a drive shaft 15 which depends into a drive shaft housing 16 positioned beneath the power head. This drive shaft 15 further depends into a lower unit 17 where a forward, neutral bevel gear transmission 18 is provided for driving a propeller 19 in selected forward and reverse directions.

A steering shaft (not shown) is affixed to the drive shaft housing 16 and is journalled for steering movement about a vertically extending steering axis within a swivel bracket 21. A tiller 22 is affixed to the upper end of the steering shaft for steering of the outboard motor 11 in a well known manner.

A pivot pin 23 extends in a generally horizontal direction and pivotally connects the swivel bracket 21 with a clamping bracket 24 for tilt and trim movement of the outboard motor 11, as is well known in this art. A clamping device 25 is carried by the clamping bracket 24 for detachably affixing the outboard motor 11 to a transom 26 of an associated watercraft. The construction of the outboard motor 11 as thus far described, may be considered to be conventional and, for that reason, further details of the construction and operation are not believed to be necessary to understand the invention.

Referring now additionally to the remaining figures, the engine 12 is, in the illustrated embodiment, of the in-line, three cylinder type and includes a cylinder block 27 in which three cylinder bores 28 are formed by respective pressed or cast-in liners 29. Although the invention is described in conjunction with a three cylinder, in-line type of engine, it should be readily apparent to those skilled in the art that the invention can be employed with engines having other cylinder numbers or types or, as has been noted above, with other types of devices than reciprocating engines such as rotary engines or the like.

Pistons 31 are supported for reciprocation in each of the cylinder bores 28. The pistons 31 are connected by means of piston pins 32 to connecting rods 33. The large or big end of the connecting rods 33 are connected to respective throws of the crankshaft 14 is a well known manner. The crankshaft 14 is journalled for rotation about a vertically extending axis, as aforenoted, within a crankcase chamber 34 formed by the skirt of the cylinder block 27 and a crankcase member 35 which is affixed to the cylinder block 27 in a known manner.

A cylinder head assembly 36 is affixed in a suitable manner to the cylinder block 27 and has three recesses 37, which cooperate with the heads of the pistons 31 and cylinder bores 28 to form the combustion chamber.

A fuel charge is injected into the recesses 37 by fuel injectors 38 mounted in the cylinder head in a suitable manner. The fuel injectors 38 may inject compressed air as well as fuel.

The charge which has been formed in the combustion chamber is fired by spark plugs 39 mounted in the cylinder head and fired by an ignition system of a known type.

A supercharger, indicated generally by the reference numeral 41 is located at the end of the engine opposite the cylinder block 27 and adjacent the crankcase member 35 for delivering a compressed air charge to the combustion chambers of the engine 12. This supercharger 41 includes an outer housing 42 that defines an air inlet opening 43 in which a throttle valve 44 is positioned. Air is drawn from the area within the protective cowling 13 through the air inlet opening 43 and past the throttle valve 44, which throttle valve 44 serves the function of controlling the speed of the engine.

Figure 5:
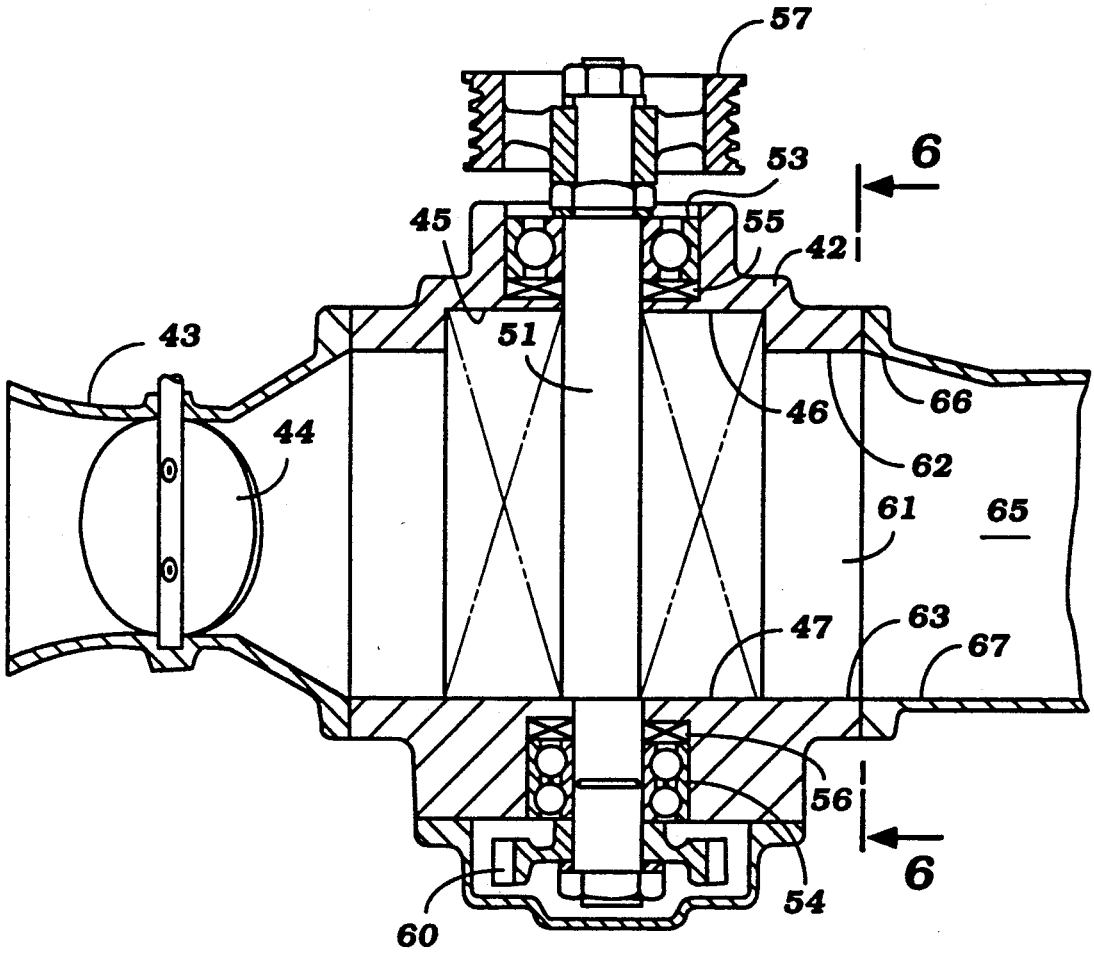
FIG. 5 is a still further enlarged cross sectional view taken along the line 5—5 of FIG. 4.
Figure 6:
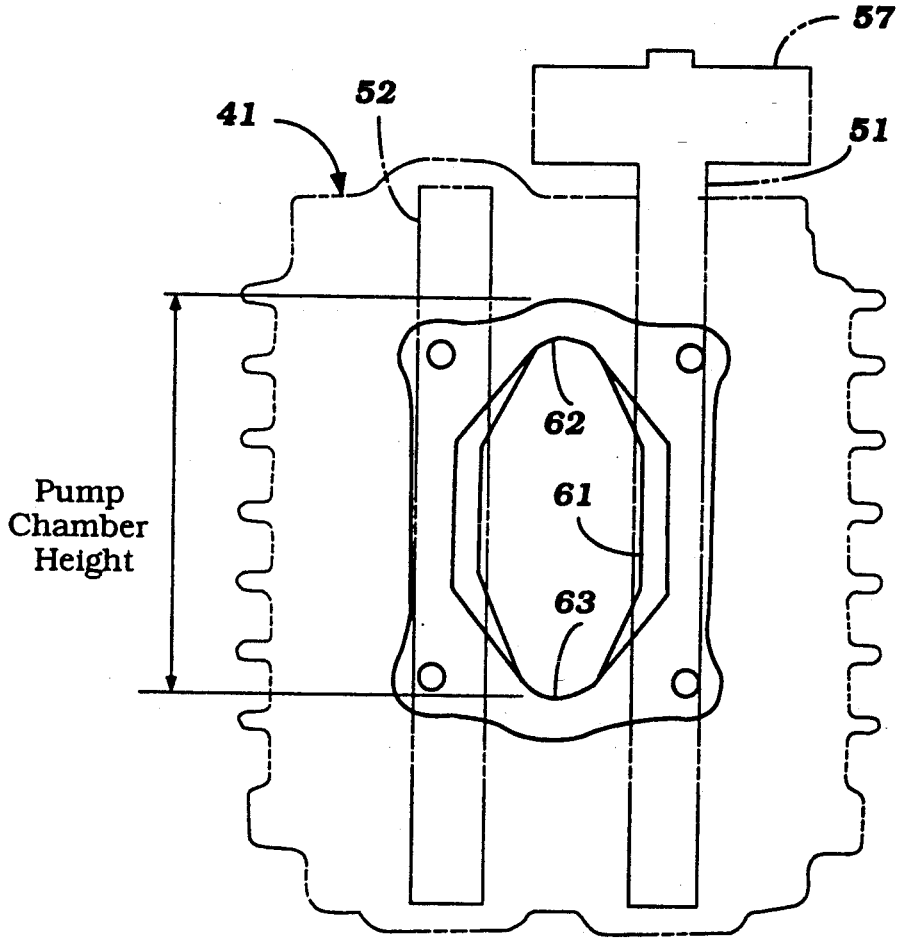
FIG. 6 is a view taken along the line 6—6 of FIG. 5.

The housing 42 includes a pumping chamber 45 that has a generally FIG. 8 configuration as seen in cross sectional and which is defined by generally planar upper and lower surfaces with the upper surface being indicated by the reference numeral 46 in FIG. 5 and the lower surface being indicated by the reference numeral 47.

A pair of rotors 48 and 49 are fixed on respective rotor shafts 51 and 52 each of which is journalled for rotation about axes parallel to the axis of rotation of the crankshaft 14 in a suitable manner. As may be seen in FIG. 5, the bearing arrangement for the shaft 51 includes an upper bearing assembly 53 and a lower bearing assembly 54 with the bearings 53 and 54 being sealed from the pumping chamber 46 by respective seals 55 and 56. The shaft 51 has a pulley 57 affixed to its upper end which is driven by a belt 58 from a pulley 59 affixed to the upper end of the crankshaft 14. A gear 60 is carried on the lower end of the shaft 51 and meshes with a corresponding gear carried by the shaft 52 for rotating the rotor 49.

The rotors 48 and 49 have an intermeshing relationship, as is well known in this art, and cause air to be drawn through the inlet 43 and discharged through a discharge opening 61 formed in the housing 42.

The discharge opening 61 is defined by an upper wall 62 and a lower wall 63. In accordance with an important feature of the invention, the lower wall 63 of the discharge opening 61 is disposed so that it does not extend at all above the lower wall 47 of the pumping cavity 45. Therefore, if there is any water that condenses within the pumping cavity 45 when the engine 12 is not running, this water will not remain in the pumping cavity 45 where it could corrode the shafts 51 and 52, their bearings or the intermeshing rotor lobes 48 and 49. This water, rather, will flow out of the pumping cavity 45.

The compressed air which is discharged through the compressor outlet opening 61 is delivered to a scavenge manifold, indicated generally by the reference numeral 64, which scavenge manifold has an internal passage 65 that communicates with the compressor outlet opening 61. This scavenge manifold passage 65 also has an upper wall 66 and a lower wall 67 and the lower wall 67 is no higher than the lower wall 63 of the outlet opening 61 and no higher than the lower wall 47 of the pumping cavity 45. Hence, this lower wall 67 will not act as a dam that would tend to preclude the flow of liquid from the pumping cavity 45 when the engine is not running.

Figure 4:
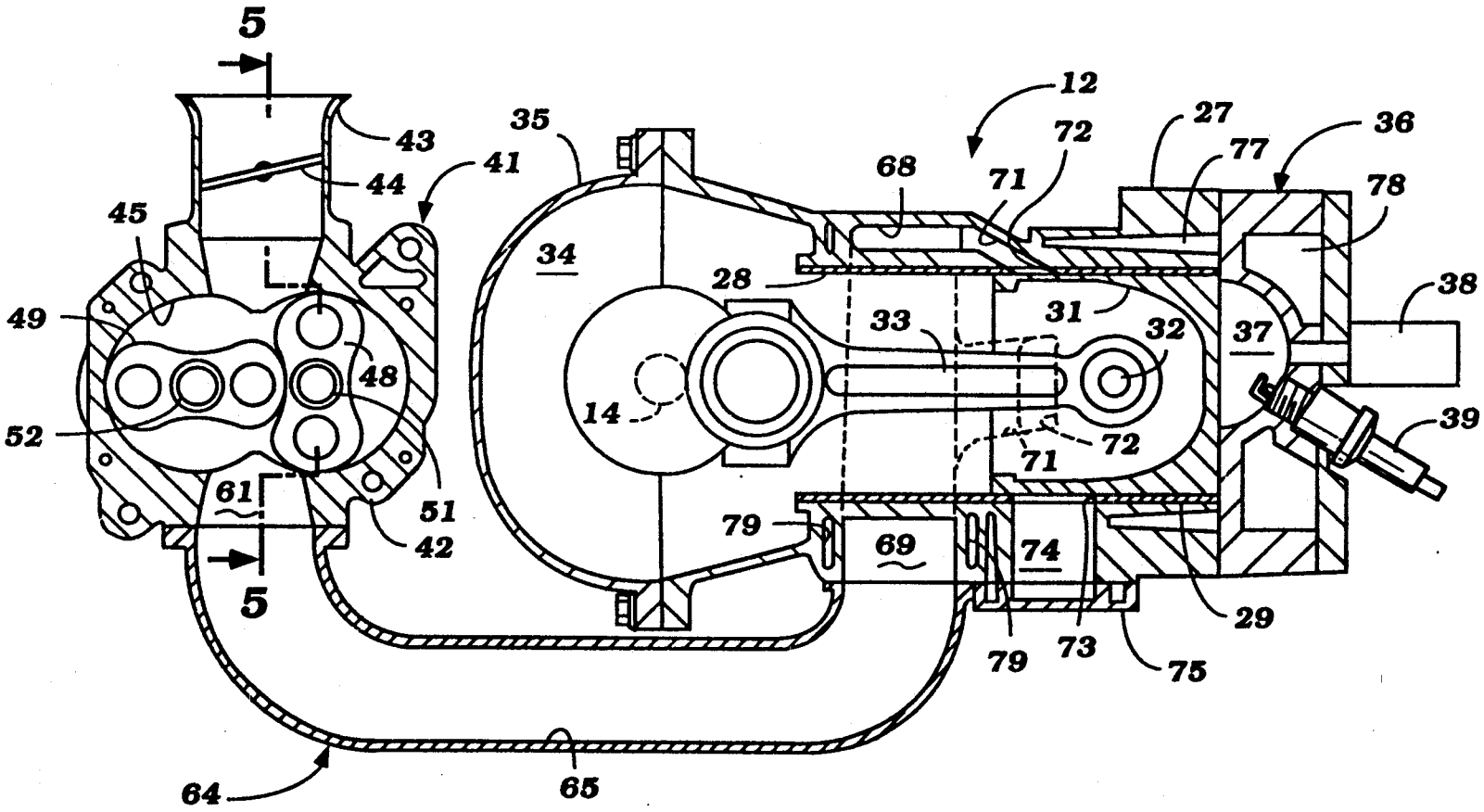
FIG. 4 is a further enlarged cross sectional view taken along the line 4—4 of FIG. 3.

As may be best seen in FIG. 4, the cylinder block 27 is formed with an internal plenum chamber 68 which extends around the lower portion of the cylinder liners 29 and thus serves as a common plenum chamber for each of the cylinder bores 28. An air inlet opening 69 is formed in a side of the cylinder block 27 and permits the manifold passageway 65 to communicate with this plenum chamber 68.

A plurality of scavenge passages 71 are formed in the cylinder block 27 around each liner 29, there being three such scavenge passages 71 per cylinder in the illustrated embodiment. Each scavenge passage 71 terminates at a scavenge port 72 formed in the respective cylinder liner 29 which is opened and closed by respective pistons 31. Hence, when the scavenge ports 72 are opened, a fresh air charge will be forced into the combustion chamber. The scavenge passages 71 and scavenge ports 72 are preferably disposed so as to provide a loop or Schnurle type of scavenging action within each cylinder bore 28.

When the air charge is admitted to the combustion chambers including the recesses 37, at an appropriate point in time the fuel injector 38 will inject fuel and the charge will be ignited by firing of the spark plug 39. This causes the piston 31 to be driven downwardly and the gases will continue to expand until an exhaust port 73 formed in each cylinder liner 29 between two of the scavenge ports 72 will be opened. At this time, the exhaust gases can flow into an exhaust manifold 74 formed in one side of the cylinder block 27 and enclosed by an enclosure plate 75. The exhaust gases are then discharged downwardly through an exhaust pipe 76 (FIG. 1) into the drive shaft housing 16 where an expansion chamber is formed. The exhaust gases are then discharged to the atmosphere from this expansion chamber through any known type of exhaust discharge system which may include an underwater high speed exhaust gas discharge and an above-the-water low speed exhaust gas discharge, as are well known in this art.

In the illustrated embodiment, the engine 12 is water-cooled and to this end there is provided a cylinder block cooling jacket 77 and a cylinder head cooling jacket 78 through which water from the body of water in which the outboard motor 11 is operating is circulated in any known manner. In addition, there is provided a cooling jacket 79 in the cylinder block 27 which extends around the plenum chamber 68 so as to provide cooling for the intake air charge and to avoid lost of volumetric efficiency.

It should be readily apparent from the foregoing description, that the described construction provides a system for supercharging the intake air for the engine but which will insure that any water can not accumulate within the pumping cavity of the supercharger when the engine is not running. Of course, the foregoing description is that of a preferred embodiment of the invention and various changes and modifications may be made without departing from the spirit and scope of the invention, as defined by the appended claims. For example, the invention is described in conjunction with a positive displacement type of supercharger (Roots type) but it is to be understood that the invention can also be employed with other types of air compressors than that illustrated and other air compressors than superchargers.

We claim:

1. An air compressor comprising an outer housing defining a pumping chamber, a moveable element within said pumping chamber for drawing a charge into said pumping chamber and compressing the charge therein, an inlet opening for communicating with said pumping chamber for admitting a charge to said pumping chamber, and an outlet opening communicating with said pumping chamber for permitting a charge to be delivered from said pumping chamber, at least one of said openings having its lower wall extending no higher than the lower wall of the pumping chamber for draining of liquid from the pumping chamber through said one opening when the compressor is not operating.

2. An air compressor as set forth in claim 1 wherein the one opening comprises the outlet opening.

3. An air compressor as set forth in claim 1 wherein the pumping element is driven by a shaft rotatably about a vertically extending axis.

4. An air compressor as set forth in claim 3 wherein at least one of the openings is formed in a side wall of the housing.

5. An air compressor as set forth in claim 4 wherein both of the openings are formed in the side wall of the housing.

6. An air compressor as set forth in claim 5 wherein the one opening comprises the outlet opening.

7. An air compressor as set forth in claim 3 wherein the pumping element comprises an internal rotor contained within the pumping chamber and wherein the upper and lower walls of the pumping chamber are generally planar.

8. An air compressor as set forth in claim 7 wherein both of the openings are formed in the side wall of the housing.

9. An air compressor as set forth in claim 8 wherein the one opening comprises the outlet opening.

10. An air compressor as set forth in claim 1 further including an internal combustion engine for powering a marine propulsion unit driving the air compressor.

11. An air compressor as set forth in claim 10 wherein the air compressor supplies compressed air to the engine for its operation.

12. An air compressor as set forth in claim 11 wherein the engine is a two-cycle engine.

13. An air compressor as set forth in claim 12 wherein the air is delivered to a scavenging system for the engine.

* * * * *